US009711864B2

(12) United States Patent
Vin et al.

(10) Patent No.: US 9,711,864 B2
(45) Date of Patent: Jul. 18, 2017

(54) ANTENNA DEVICE OF A MOBILE TERMINAL

(71) Applicant: Samsung Electronics Co., Ltd., Suwon-si, Gyeonggi-do (KR)

(72) Inventors: Young Boo Vin, Hwasung-si (KR); Dong Hyun Lee, Suwon-si (KR); Soon Ho Hwang, Seoul (KR); Hae Yeon Kim, Suwon-si (KR); Bum Jin Cho, Hwasung-si (KR); Se Hyun Park, Suwon-si (KR); Joon Ho Byun, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/603,653

(22) Filed: Jan. 23, 2015

(65) Prior Publication Data

US 2015/0130670 A1 May 14, 2015

Related U.S. Application Data

(63) Continuation of application No. 13/343,863, filed on Jan. 5, 2012, now Pat. No. 8,963,783.

(30) Foreign Application Priority Data

Aug. 22, 2011 (KR) ..... 10-2011-0083212

(51) Int. Cl.

| | |
|---|---|
| ***H01Q 1/24*** | (2006.01) |
| ***H01Q 19/00*** | (2006.01) |
| ***H01Q 1/22*** | (2006.01) |
| ***H01Q 1/44*** | (2006.01) |
| ***H01Q 9/42*** | (2006.01) |
| ***H01Q 5/364*** | (2015.01) |

(52) U.S. Cl.

CPC ..... *H01Q 19/005* (2013.01); *H01Q 1/22* (2013.01); *H01Q 1/243* (2013.01); *H01Q 1/44* (2013.01); *H01Q 5/364* (2015.01); *H01Q 9/42* (2013.01)

(58) Field of Classification Search

CPC ..... H01Q 19/005; H01Q 1/243; H01Q 5/364; H01Q 9/42

USPC ..... 343/700 MS, 702

See application file for complete search history.

(56) References Cited

U.S. PATENT DOCUMENTS

| | | | | |
|---|---|---|---|---|
| 4,410,890 | A | 10/1983 | Davis et al. | |
| 6,686,886 | B2 | 2/2004 | Flint et al. | |
| 6,864,848 | B2 * | 3/2005 | Sievenpiper | H01Q 9/14 343/767 |
| 6,956,530 | B2 | 10/2005 | Kadambi et al. | |
| 7,132,992 | B2 * | 11/2006 | Mori | H01Q 3/44 343/700 MS |
| 7,688,267 | B2 | 3/2010 | Hill | |

(Continued)

FOREIGN PATENT DOCUMENTS

| | | |
|---|---|---|
| EP | 1 662 606 A1 | 5/2006 |
| JP | 2002-368535 A | 12/2002 |

*Primary Examiner* — Tho G Phan

(74) *Attorney, Agent, or Firm* — Jefferson IP Law, LLP

(57) ABSTRACT

An antenna device of a mobile terminal having improved performance by utilizing a metal object located in proximity to the antenna device as an antenna radiator is provided. The antenna device includes an antenna pattern connected to a feeder and a ground line, and a metal component positioned on the antenna pattern and including a metal that forms an antenna radiator.

23 Claims, 11 Drawing Sheets

(56) References Cited

U.S. PATENT DOCUMENTS

| | | | | |
|---|---|---|---|---|
| 7,705,786 | B2 * | 4/2010 | Iellici | H01Q 1/243 343/700 MS |
| 7,821,463 | B2 | 10/2010 | Nishikido et al. | |
| 8,085,202 | B2 * | 12/2011 | Ayatollahi | H01Q 1/243 343/700 MS |
| 8,203,493 | B2 | 6/2012 | Sato et al. | |
| 8,599,088 | B2 | 12/2013 | Chiang et al. | |
| 8,963,783 | B2 * | 2/2015 | Vin | H01Q 1/22 343/700 MS |
| 9,035,833 | B2 * | 5/2015 | Zhang | H01Q 1/243 343/702 |
| 2002/0019247 | A1 * | 2/2002 | Egorov | H01Q 1/243 455/557 |
| 2007/0109203 | A1 | 5/2007 | Park et al. | |
| 2007/0236394 | A1 * | 10/2007 | Aoyama | H01Q 1/243 343/700 MS |
| 2009/0167631 | A1 | 7/2009 | Tai et al. | |
| 2009/0179802 | A1 | 7/2009 | Tsai et al. | |
| 2010/0164835 | A1 | 7/2010 | Tai et al. | |
| 2011/0016702 | A1 | 1/2011 | Byun et al. | |
| 2011/0136447 | A1 | 6/2011 | Pascolini et al. | |

* cited by examiner

ANTENNA DEVICE OF A MOBILE TERMINAL

CROSS-REFERENCE TO RELATED APPLICATION(S)

This application is a continuation application of a prior application Ser. No. 13/343,863, filed on Jan. 5, 2012, which claimed the benefit under 35 U.S.C. §119(a) of a Korean patent application filed on Aug. 22, 2011 in the Korean Intellectual Property Office and assigned Serial number 10-2011-0083212, the entire disclosure of which is hereby incorporated by reference.

BACKGROUND OF THE INVENTION

1. Field of the Invention

The present invention relates to an antenna device of a mobile terminal. More particularly, the present invention relates to an antenna device of a mobile terminal having improved performance by utilizing a metal object located in proximity to the antenna device as an antenna radiator.

2. Description of the Related Art

A mobile terminal has many metal components, located in the limited internal space, to provide various features. Because an antenna is also located within the mobile terminal, the plurality of metal objects are located in proximity of the antenna device. The metal objects can influence the performance of the antenna device of the mobile terminal, and therefore, extensive research on this phenomenon has been conducted.

FIG. 1 is a perspective view of an antenna device of a mobile terminal according to the related art.

Referring to FIG. 1, an antenna device 100 of a mobile terminal may include an antenna pattern 110, a ground unit 120, and Intermediate Frequency (IF) connector 130. The antenna pattern 110 is connected to a feeder 111 and a ground line 112. The ground line 112 is connected to the ground unit 120, which is formed on a Printed Circuit Board (PCB) 140. The IF connector 130 may be a Universal Serial Bus (USB) connector, which is provided on a bottom portion of the mobile terminal to receive an external signal or to supply power. The IF connector 130 is mounted on the PCB 140. The IF connector 130, which is composed of metal, is positioned with a certain interval from the antenna pattern 110.

The antenna pattern 110 of the antenna device 100 of the mobile terminal has many metal components, including the IF connector 130, arranged in close proximity thereto. In addition, in order to reinforce mechanical strength of the mobile terminal, a case (not shown) of the mobile terminal can be composed of metal. However, the metal components located near the antenna pattern 110 or the metal case may lower the efficiency and bandwidth of the antenna. Furthermore, avoiding the use of metal components when designing the antenna device can be difficult.

Therefore, a need exists for an antenna device of a mobile terminal, of which performance is not degraded when a metal component is positioned in proximity or when the mobile terminal has a metal case.

SUMMARY OF THE INVENTION

Aspects of the present invention are to address at least the above-mentioned problems and/or disadvantages and to provide at least the advantages described below. Accordingly, an aspect of the present invention is to provide an antenna device of a mobile terminal, of which performance is not degraded when a metal component is positioned in proximity or when the mobile terminal has a metal case.

In accordance with an aspect of the present invention, an antenna device of a mobile terminal is provided. The antenna device includes an antenna pattern connected to a feeder and a ground line, and a metal component positioned on the antenna pattern and including a metal that forms an antenna radiator.

In accordance with another aspect of the present invention, an antenna device of a mobile terminal is provided. The antenna device includes an antenna pattern comprising metal in which a slot is formed, and a metal component positioned on the antenna pattern and comprising a metal that forms an antenna radiator.

According to exemplary embodiments of the present invention, the metal component that forms the antenna radiator is positioned on the antenna pattern so that a decrease in antenna efficiency and bandwidth due to the metal component can be avoided. In addition, when designing the antenna, the use of the metal component is not restricted.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Exemplary embodiments of the present invention provide an antenna device of a mobile terminal having improved performance by utilizing a metal object located in proximity to the antenna device as an antenna radiator.

FIGS. 1 through 11, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly stated otherwise. A set is defined as a non-empty set including at least one element.

Figure 2:
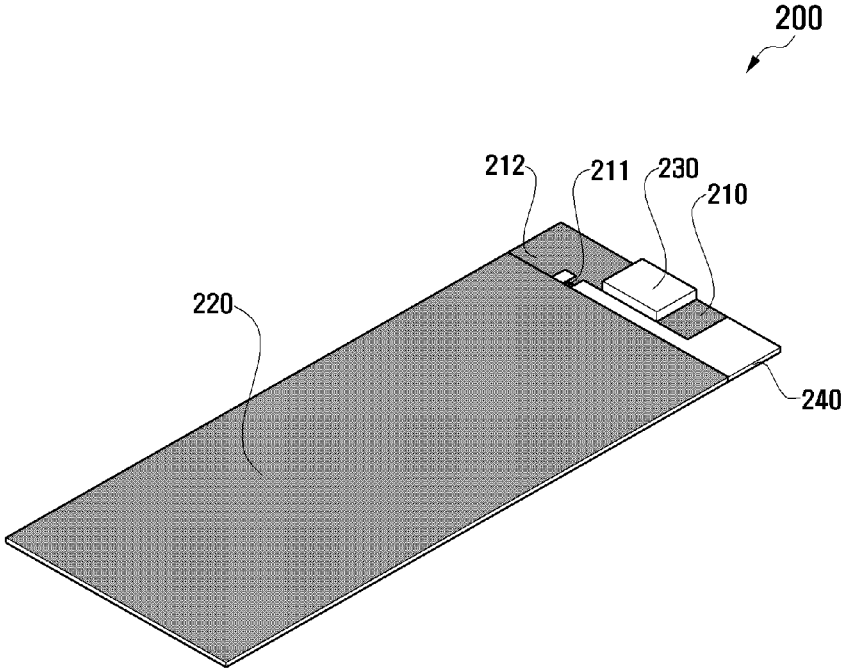
FIG. 2 is a perspective view of an antenna device of a mobile terminal according to a first exemplary embodiment of the present invention.

FIG. 2 is a perspective view of an antenna device of a mobile terminal according to a first exemplary embodiment of the present invention.

Referring to FIG. 2, an antenna device 200 of the mobile terminal may include an antenna pattern 210 and an Intermediate Frequency (IF) connector 230.

The antenna pattern 210 radiates a signal, which is transmitted from a wireless communication module (not shown) of the mobile terminal (not shown) and received through a feeder 211 connected to the antenna pattern 210. In addition, the antenna pattern 210 transmits a received external radio signal to the wireless communication module through the feeder 211. The antenna device 200 of the mobile terminal is a reverse F antenna, in which a ground line 212 is formed near the feeder 211, wherein the ground line 212 has a first terminal connected to the antenna pattern 210 and a second terminal connected to a ground unit 220.

The IF connector 230, which may be a Universal Serial Bus (USB) connector used to receive an external signal or supply power, is a metal component, i.e., the IF connector 230 comprises a metal. The IF connector 230 is positioned on the antenna pattern 210 and comprises a metal that serves as an antenna radiator. The metal, which makes up the IF connector 230 and serves as the antenna radiator, is preferably used to form a housing of the antenna pattern 210. Accordingly, the IF connector 230 does not interfere but rather enhances radiation of the antenna pattern 210. In addition, in the related art, the antenna pattern 210 is formed in a planar structure so that a current in the antenna pattern 210 flows only in a two-dimensional manner. On the contrary, according to an exemplary embodiment of the present invention, a current passes through the antenna pattern 210 in a three-dimensional manner due to a cubic housing of the IF connector 230. Thus, antenna performance can be improved because a current can flow across a wider area than that of the related art. Among multiple layers that form a Printed Circuit Board (PCB) 240, a PCB line (not shown) of the IF connector 230 is formed on a layer different from a layer on which the antenna pattern 210 is formed, thereby preventing interference between a current flowing through the antenna pattern 210 and a current flowing through the PCB line of the IF connector 230.

It should be noted that the antenna device 200 of the mobile terminal can serve as a main antenna as well as an antenna for use in sub-communication including, for example, Bluetooth, Global Positioning System (GPS), Digital Mobile Broadcasting (DMB), Long Term Evolution (LTE), and the like.

Figure 3:
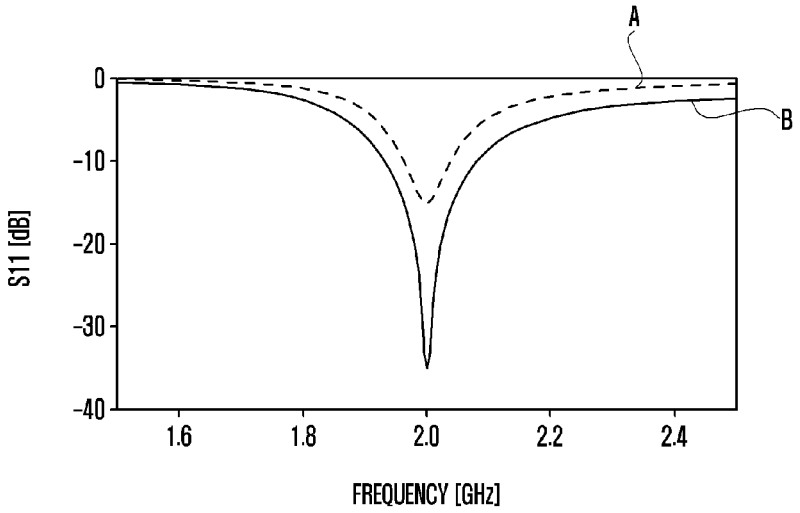
FIG. 3 illustrates a return loss of an antenna device of a mobile terminal shown in FIG. 2 according to an exemplary embodiment of the present invention.

FIG. 3 illustrates a return loss of an antenna device of a mobile terminal shown in FIG. 2 according to an exemplary embodiment of the present invention.

Figure 1:
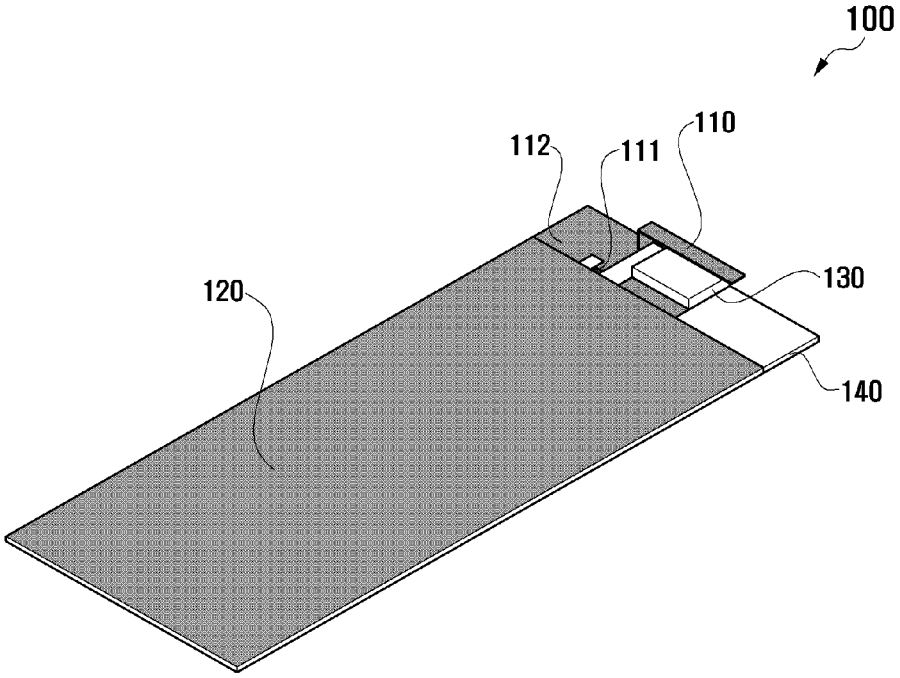
FIG. 1 (RELATED ART)
FIG. 1 is a perspective view of an antenna device of a mobile terminal according to the related art.

Referring to FIG. 3, a dotted line (A) represents a return loss of an antenna device of the related art of a mobile terminal shown in FIG. 1 and a solid line (B) represents a return loss of the antenna device of the mobile terminal shown in FIG. 2. As illustrated in FIG. 3, the antenna device of the mobile terminal shown in FIG. 2 shows improved antenna performance with a lower return loss and a wider bandwidth compared with the antenna device of the related art shown in FIG. 1.

Figure 4:
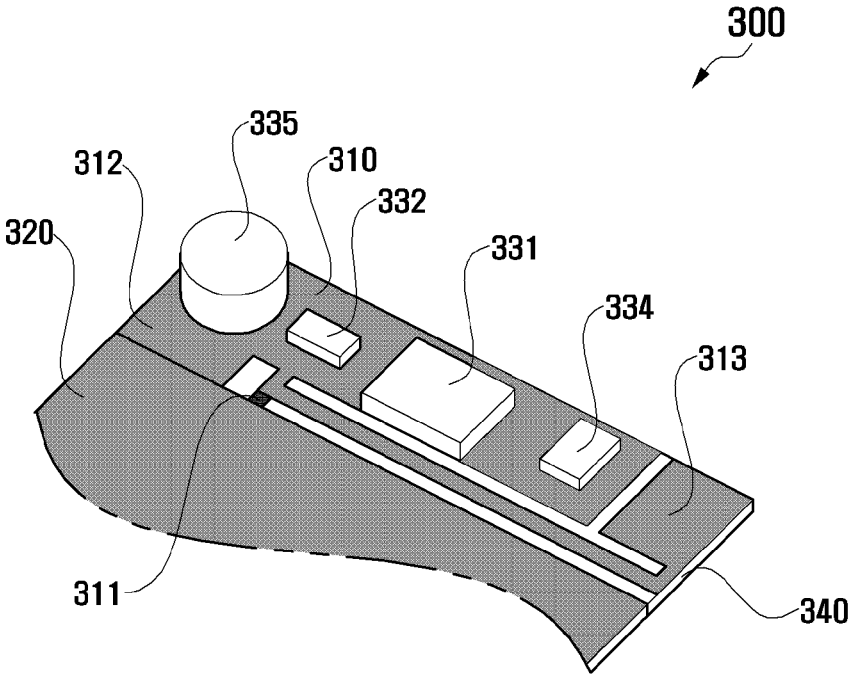
FIG. 4 is a partial perspective view illustrating a first modification of an antenna device of a mobile terminal shown in FIG. 2 according to an exemplary embodiment of the present invention.

FIG. 4 is a partial perspective view illustrating a first modification of an antenna device of a mobile terminal shown in FIG. 2 according to an exemplary embodiment of the present invention.

Referring to FIG. 4, an antenna device 300 of the mobile terminal according to the first modification of the first embodiment is described. Similar to the antenna device 200 of the mobile terminal shown in FIG. 2, the antenna device 300 of the mobile terminal may include a ground line 312 connected to a ground unit 320, which is formed on a PCB 340, and an antenna pattern 310 connected to a feeder 311.

Compared to the antenna device 200 of the mobile terminal shown in FIG. 2, the antenna device 300 of the mobile terminal may include a speaker 331, an ElectroStatic Discharge (ESD) filter 332, a microphone 334, and a motor 335, each of which is a metal component that is positioned on the antenna pattern 310 to form the antenna radiator. In addition, the antenna device 300 of the mobile terminal may further include an additional antenna pattern 313 connected to the feeder 311. Compared to the antenna device 200 of the mobile terminal shown in FIG. 2, the antenna device 300 of the mobile terminal shown in FIG. 4 has more metal components positioned on the antenna pattern 310 to form the antenna radiator. Accordingly, a current in the antenna pattern 310 flows across a wider area so that antenna performance can be improved.

Figure 6:
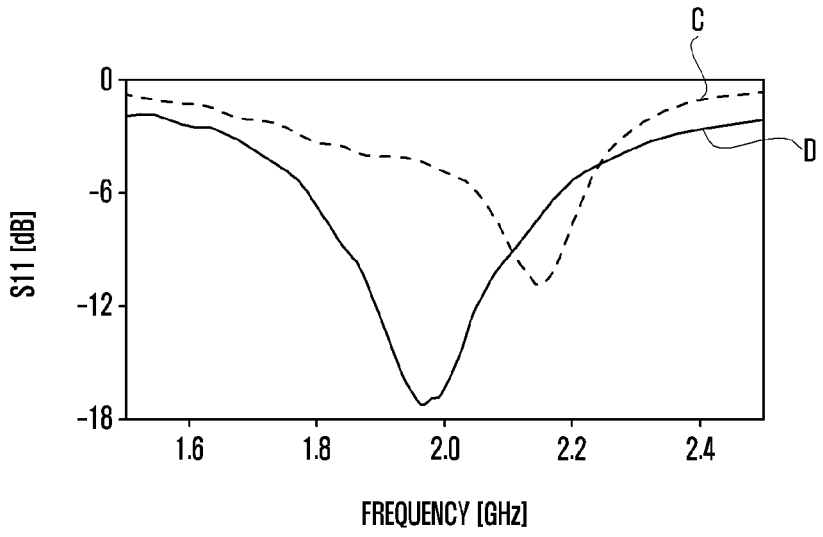
FIG. 6 illustrates a return loss of an antenna device of a mobile terminal shown in FIG. 4 according to an exemplary embodiment of the present invention.
Figure 7:
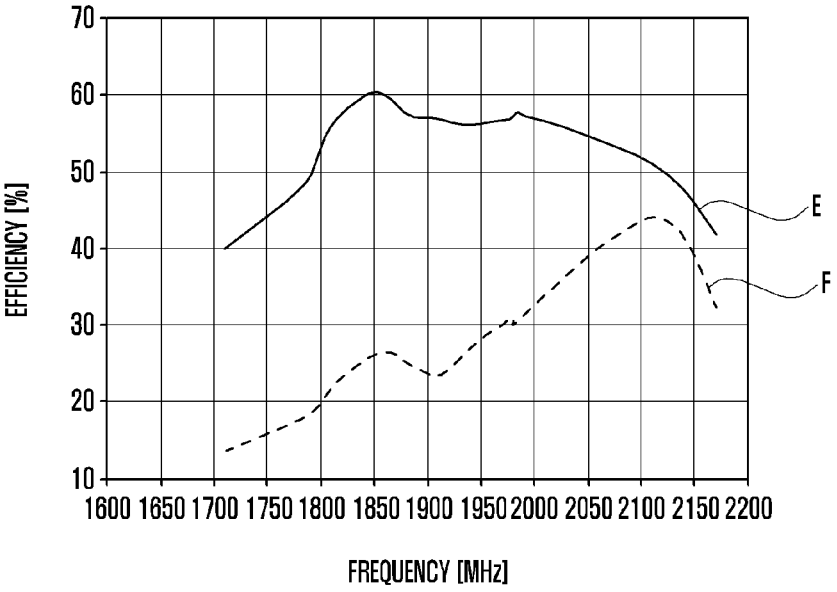
FIG. 7 illustrates an efficiency of an antenna device of a mobile terminal shown in FIG. 4 according to an exemplary embodiment of the present invention.

FIG. 6 illustrates a return loss of an antenna device of a mobile terminal shown in FIG. 4 according to an exemplary embodiment of the present invention, and FIG. 7 illustrates an efficiency of an antenna device of a mobile terminal shown in FIG. 4 according to an exemplary embodiment of the present invention.

Referring to FIGS. 6 and 7, dotted lines C and F respectively represent a return loss and an efficiency of the antenna device of the related art (not shown) of a mobile device in which the antenna pattern is formed on a carrier. In addition, solid lines D and E respectively represent a return loss and an efficiency of the antenna device 300 of the mobile device shown in FIG. 4. The antenna device 300 of the mobile device shows improved performance, i.e., a lower return loss, a wider bandwidth, and a higher efficiency compared to the antenna device of the related art.

Figure 5:
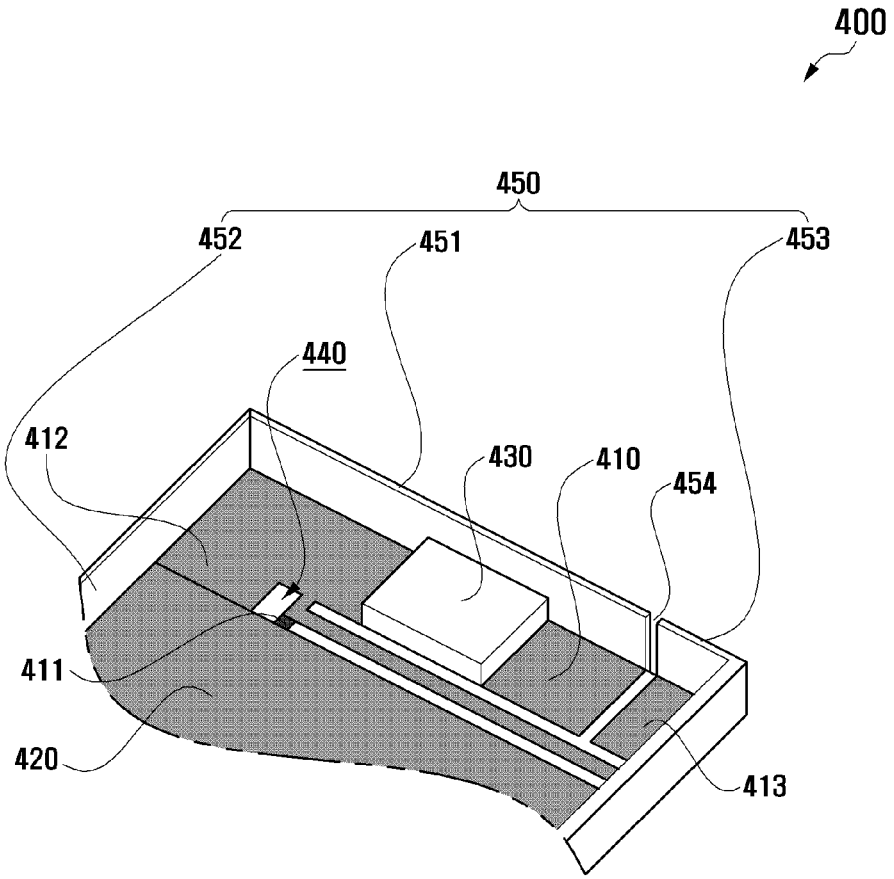
FIG. 5 is a partial perspective view illustrating a second modification of an antenna device of a mobile terminal shown in FIG. 2 according to an exemplary embodiment of the present invention.

FIG. 5 is a partial perspective view of an antenna device of a mobile terminal shown in FIG. 2 according to a second modification according to an exemplary embodiment of the present invention.

Referring to FIG. 5, an antenna device 400 of the mobile terminal according to the second modification of the first embodiment is described. Similar to the antenna device 200 of the mobile terminal shown in FIG. 2, the antenna device 400 of the mobile terminal may include a ground line 412 connected to a ground unit 420, and an antenna pattern 410 and an IF connector 430 connected to a feeder 411.

The antenna device 400 of the mobile terminal is different from the antenna device 200 shown in FIG. 2 in that the antenna device 400 may further include an additional antenna pattern 413 connected to the feeder 411. In addition, the antenna device 400 of the mobile terminal may further include a metal ring 450 that is formed along a boundary of a PCB 440 wherein the metal ring 450 is connected to the antenna pattern 410, the ground unit 420 and the additional antenna pattern 413. The metal ring 450 forms a part of a case of the mobile terminal. The metal ring 450 includes a slot 454 formed between a part 451 connected to the antenna pattern 410 and a part 453 connected to the antenna pattern 413. A part 452 of the metal ring 450 that is connected to the ground unit 420 has an effect of expanding the ground unit 420. In addition, the part 451 of the metal ring 450 that is connected to the antenna pattern 410 and the part 453 connected to the additional antenna pattern 413 serves as the antenna radiator. Accordingly, a current flowing through the antenna pattern 410 and the additional antenna pattern 413 can flow across a larger area, thereby increasing radiation efficiency and bandwidth.

Figure 8:
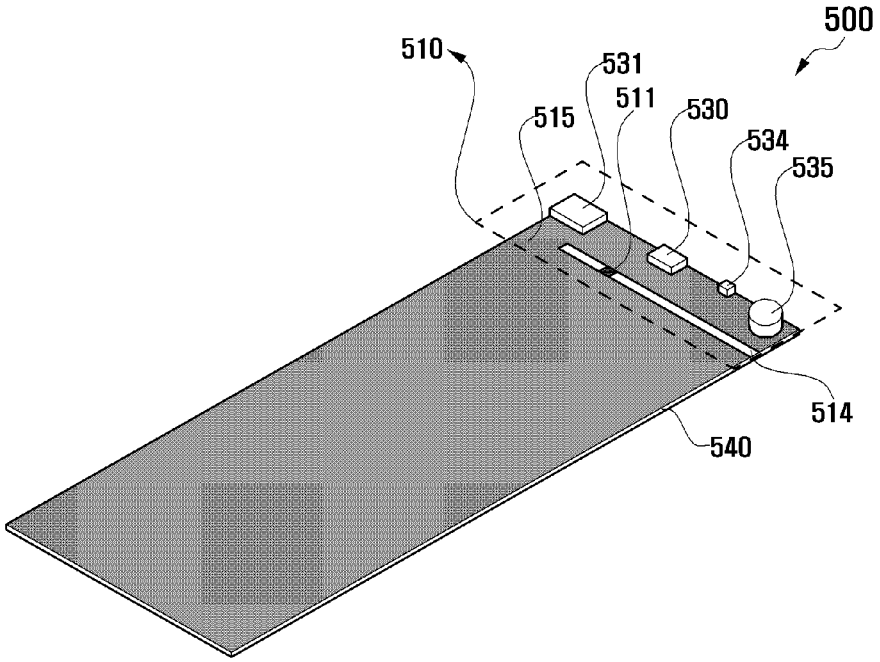
FIG. 8 is a perspective view of an antenna device of a mobile terminal according to a second exemplary embodiment of the present invention.

FIG. 8 is a perspective view of an antenna device of a mobile terminal according to a second exemplary embodiment of the present invention.

Referring to FIG. 8, an antenna device 500 of the mobile terminal may include an antenna pattern 510, an IF connector 530, a speaker 531, a microphone 534, a motor 535, and a PCB 540.

The antenna pattern 510 is formed of a metal 515 in which a slot 514 is formed. The slot 514 has a "-" shape. In addition, the slot 514 includes a feeder 511 formed therein for feeding the antenna pattern 510. A metal component, such as the IF connector 530, the speaker 531, the microphone 534, and the motor 535 is positioned on the antenna pattern 510. The IF connector 530, the speaker 531, the microphone 534, and the motor 535 respectively form the antenna radiator along with the antenna pattern 510.

According to the second exemplary embodiment, similar to the first embodiment, the metal components including the IF connector 530, the speaker 531, the microphone 534 and the motor 535 are positioned on the antenna pattern 510 to form the antenna radiator. Accordingly, the metal components further the radiation of the antenna pattern 510. In addition, antenna performance can be improved because a current, which flows through the antenna pattern 510 in a two-dimensional manner, flows through a metal housing of the metal components in a three-dimensional manner.

Figure 9:
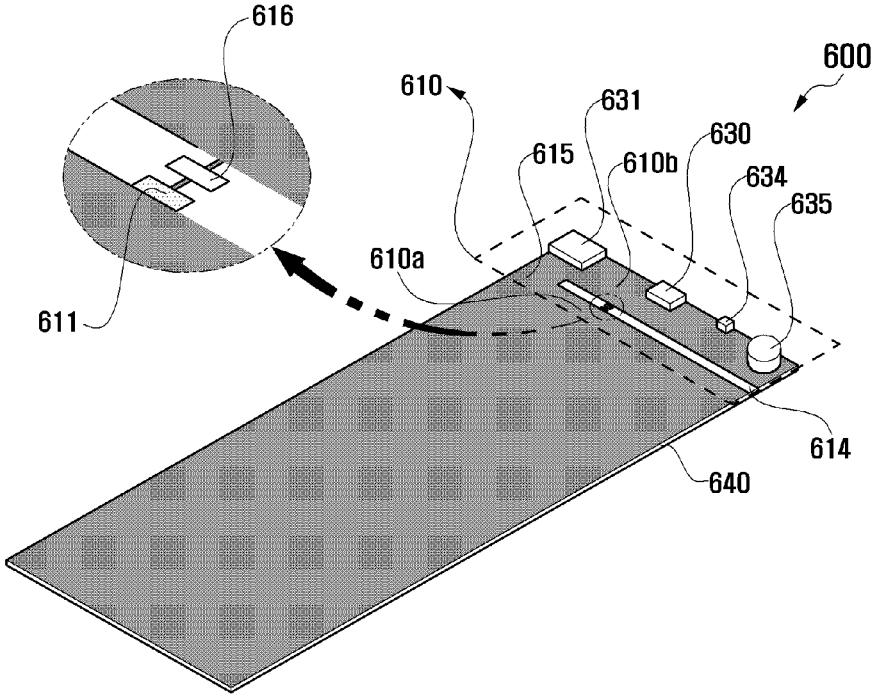
FIG. 9 is a partial perspective view illustrating a first modification of an antenna device of a mobile terminal shown in FIG. 8 according to an exemplary embodiment of the present invention.

FIG. 9 is a partial perspective view of an antenna device of a mobile terminal shown in FIG. 8 according to a first modification according to an exemplary embodiment of the present invention.

Referring to FIG. 9, an antenna device 600 of the mobile terminal according to the first modification of the second embodiment of the present invention is described. Similar to the antenna device 500 of the mobile terminal shown in FIG. 8, the antenna device 600 of the mobile terminal may include an antenna pattern 610 formed of a metal 615 in which a slot 614 is formed, and an IF connector 630, a speaker 631, a PCB 640, a microphone 634 and a motor 635 that are positioned on the antenna pattern 610 to form the antenna radiator.

In the antenna device 600 of the mobile terminal, the antenna pattern 610 may include parts 610*a* and 610*b* that are facing each other with the slot 614 being interposed there between, wherein the parts 610*a* and 610*b* are connected to each other through a feeder 611. In addition, compared to the antenna device 500 in FIG. 8, a capacitor 616 is connected to the feeder 611. Accordingly, the antenna device 600 of the mobile terminal can adjust an antenna matching arrangement more easily than the case of FIG. 8.

Figure 10:
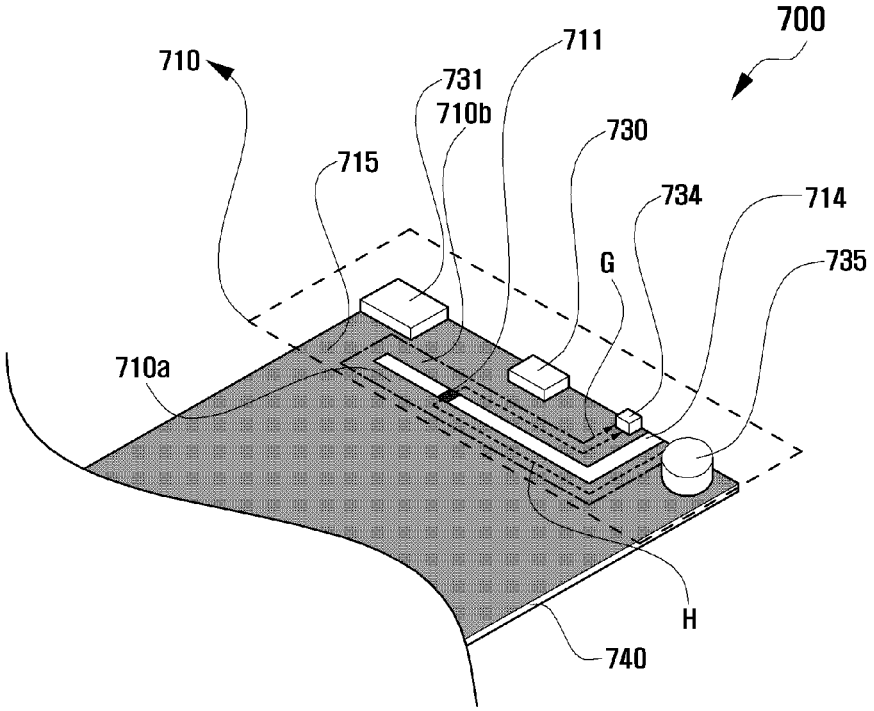
FIG. 10 is a partial perspective view illustrating a second modification of an antenna device of a mobile terminal shown in FIG. 8 according to an exemplary embodiment of the present invention.

FIG. 10 is a partial perspective view illustrating a second modification of an antenna device of a mobile terminal shown in FIG. 8 according to an exemplary embodiment of the present invention.

Referring to FIG. 10, an antenna device 700 of the mobile terminal according the second modification of the second embodiment of the present invention is described. Similar to the antenna device 500 of the mobile terminal shown in FIG. 8, the antenna device 700 of the mobile terminal may include an antenna pattern 710 formed in a metal 715 in which a slot 714 is formed, and an IF connector 730, a speaker 731, a PCB 740, a microphone 734, and a motor 735 that are positioned on the antenna pattern 710 to form the antenna radiator.

Compared to the antenna device 500 shown in FIG. 8, in the antenna device 700 of the mobile terminal, the slot 714 has a "∟" shape. In addition, the antenna pattern 710 may have two parts 710*a* and 701*b* that are facing each other with the slot 714 being interposed there between, wherein the parts 710*a* and 710*b* are connected to each other through a feeder 711. Accordingly, a current flows along a path represented by an alternative long and short dash lined arrow (G) in a case of a low-frequency band and flows along a path represented by a dotted line arrow (H), which is shorter than the path represented by the arrow (G), in a case of a high-frequency band. Thus, the antenna device 700 can operate as a dual-band antenna. In this case, a current is described to flow in a direction of the arrow (G) or the arrow (H) depending on a frequency band. However, in a real application, a current flows not only in the path represented by the arrow (G) or (H) but also in a peripheral area of the path represented by the arrow (G) or (H) and a metal forming the metal components including the IF connector 730, the speaker 731, the microphone 734, and the motor 735 of the antenna pattern 710.

Figure 11:
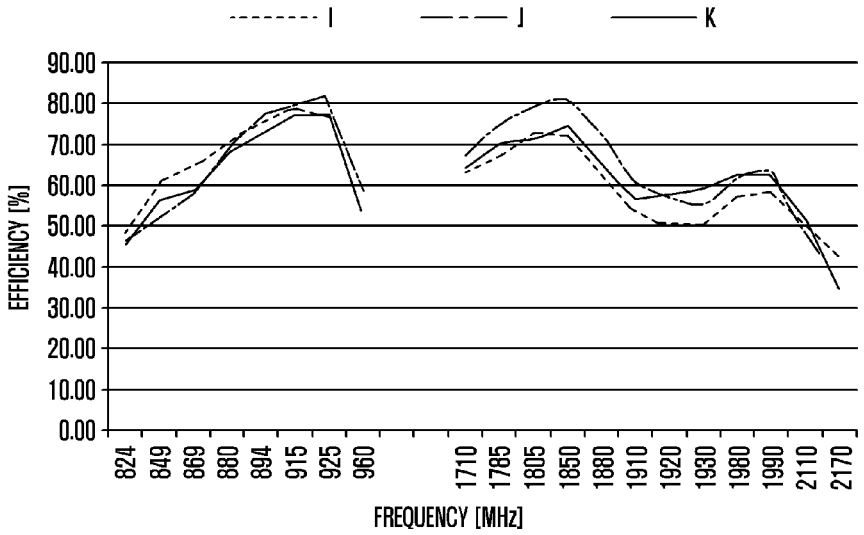
FIG. 11 illustrates an efficiency of an antenna device of a mobile terminal shown in FIG. 10 according to an exemplary embodiment of the present invention.

FIG. 11 illustrates an efficiency of an antenna device of a mobile terminal shown in FIG. 10 according to an exemplary embodiment of the present invention.

Referring to FIG. 11, a dotted line (I) indicates an efficiency of the antenna device of the related art (not shown) of the mobile terminal in which a metal component is not located in proximity thereto, an alternative long and short dash line (J) indicates an efficiency of the mobile terminal 700 of the mobile terminal shown in FIG. 10 and a solid line (K) indicates an efficiency of the antenna device 700 of the mobile terminal shown in FIG. 10 when embedded in the mobile terminal.

The antenna device 700 shows a substantially equal level of efficiency as that of the antenna device of the related art of the mobile terminal in which the metal component is not positioned nearby, regardless of whether the antenna device 700 is mounted within the mobile terminal. Since the antenna device of the related art of the mobile terminal has a metal component located nearby in a real application, the antenna device 700 of the mobile terminal shown in FIG. 10 has a higher efficiency than the antenna device of the mobile terminal of the related art.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An apparatus comprising:

an antenna including an antenna pattern radiating a signal; and a component including a conductive portion, the component positioned on a surface of the antenna pattern and substantially in an interior of the apparatus, wherein the conductive portion is configured to radiate a same signal as the signal radiated by the antenna pattern.

2. The apparatus of claim 1, wherein the conductive portion comprises a metal portion and is coupled with the antenna pattern.

3. The apparatus of claim 1, further comprising:

another antenna pattern coupled with the conductive portion.

4. The apparatus of claim 3, wherein the other antenna pattern comprises another conductive portion that forms at least part of a housing of the apparatus.

5. The apparatus of claim 3, wherein the antenna pattern is configured to radiate a signal in a high frequency band, and wherein the other antenna pattern is configured to radiate a signal in a low frequency band.

6. The apparatus of claim 3, wherein the antenna pattern and the other antenna pattern are formed on a same printed circuit board.

7. The apparatus of claim 1, wherein the component comprises at least one of an intermediate frequency connector, a speaker, an electrostatic discharge filter, a micro phone, or a motor.

8. The apparatus of claim 1, wherein the conductive portion is formed on a first layer of a plurality of layers forming a printed circuit board, and the antenna pattern is formed on a second layer of the plurality of layers.

9. The apparatus of claim 1, further comprising:

another conductive portion coupled with the antenna pattern and forming at least part of a housing of the apparatus.

10. The apparatus of claim 9, wherein the other conductive portion is coupled with a ground.

11. The apparatus of claim 1, wherein the component is configured to provide a specified function other than the radiating the signal.

12. An apparatus comprising:

an antenna pattern radiating a first signal and a slot formed in at least one portion of a printed circuit board;

a feeder formed in the slot and coupled with the antenna pattern; and a component positioned on a surface of the antenna pattern and including a conductive portion configured to radiate a same signal as the signal radiated by the antenna pattern.

13. The apparatus of claim 12, wherein the at least one portion comprises a first portion and a second portion, the slot being interposed between the first portion and the second portion.

14. The apparatus of claim 12, wherein the conductive portion is coupled with the antenna pattern.

15. The apparatus of claim 12, wherein the conductive portion is to be electrically coupled with a ground formed in another portion of the printed circuit board.

16. The apparatus of claim 12, wherein the component is positioned on a surface of the antenna pattern and is substantially in an interior of the apparatus.

17. The apparatus of claim 12, wherein the component is configured to provide a specified function other than the radiating the signal.

18. An apparatus comprising:

a first antenna pattern radiating a first signal including a slot formed adjacent thereto;

a second antenna pattern radiating a second signal; and a component positioned on a surface of the first antenna pattern and including a conductive portion coupled with the second antenna pattern to radiate a same at least one of the first signal and the second signal as radiated by at least one of the first antenna pattern and the second antenna pattern.

19. The apparatus of claim 18, further comprising:

a feeder formed in the slot and coupled with the first antenna pattern.

20. The apparatus of claim 18, wherein the first antenna pattern is configured to radiate a signal in a first frequency band, and wherein the second antenna pattern is configured to radiate a signal in a second frequency band.

21. The apparatus of claim 18, wherein the conductive portion forms at least part of a housing of the component.

22. The apparatus of claim 18, wherein the conductive portion expands a ground to be coupled with the conductive portion along with the first antenna pattern.

23. The apparatus of claim 18, wherein the component is configured to provide a specified function other than the radiating at least one of the first signal and the second signal.

* * * * *